US010723035B1

(12) United States Patent
Swiatkowski et al.

(10) Patent No.: US 10,723,035 B1
(45) Date of Patent: Jul. 28, 2020

(54) PUNCH

(71) Applicant: Southwire Company, LLC, Carrollton, GA (US)

(72) Inventors: Bradley Swiatkowski, Mesa, AZ (US); Timmothy R. Bardin, Carrollton, GA (US); Joseph R. Gerardo, Victorville, CA (US)

(73) Assignee: Southwire Company, LLC, Carrollton, GA (US)

( * ) Notice: Subject to any disclaimer, the term of this patent is extended or adjusted under 35 U.S.C. 154(b) by 133 days.

(21) Appl. No.: 14/800,152

(22) Filed: Jul. 15, 2015

Related U.S. Application Data

(60) Provisional application No. 62/024,709, filed on Jul. 15, 2014.

(51) Int. Cl.
*B26F 1/00* (2006.01)
*B26F 1/36* (2006.01)
*B26D 7/01* (2006.01)

(52) U.S. Cl.
CPC ..... *B26F 1/36* (2013.01); *B26D 7/015* (2013.01); *B26F 2001/365* (2013.01)

(58) Field of Classification Search
CPC ..... B26F 1/36; B26F 2001/365; B26D 7/015; F04B 9/103; B21J 15/20; B21J 15/26; B25F 5/005
See application file for complete search history.

(56) References Cited

U.S. PATENT DOCUMENTS 1,418,474 A * 6/1922 Rosenberg ..... B26D 7/015 30/363
2,335,552 A * 11/1943 Unger ..... B26F 1/36 83/145
3,564,716 A * 2/1971 Burrow ..... B21D 28/002 30/360
4,644,656 A * 2/1987 Chouinard ..... B25B 27/14 30/362
5,142,958 A 9/1992 Nordlin et al.
5,233,749 A 8/1993 Saito et al.
5,425,262 A 6/1995 Dubugnon
5,560,110 A 10/1996 Haines
5,613,300 A * 3/1997 Schmidt ..... B26B 5/001 30/125
D420,020 S * 2/2000 Morita ..... D15/128
6,065,326 A 5/2000 Frenken
6,067,830 A 5/2000 Klages et al.
6,085,422 A 7/2000 Hirabayashi
D433,903 S 11/2000 Shigo et al.
(Continued)

FOREIGN PATENT DOCUMENTS

CA 2420376 A1 2/2002
FR 2596467 A1 * 10/1987 ..... B25B 7/126
WO WO 2006113878 A2 10/2006

*Primary Examiner* — Kenneth E Peterson
*Assistant Examiner* — Liang Dong
(74) *Attorney, Agent, or Firm* — Hartman & Citrin LLC

(57) ABSTRACT

A device for punching one or more holes in a material is disclosed. The device can include a body, a fixed handle attached to the body, and a moveable handle attached to the body. The device can further include a cutting die and an adjustable depth gauge attached to the body. The adjustable depth gauge can be moveable relative to the body of the device.

5 Claims, 5 Drawing Sheets

(56) References Cited

U.S. PATENT DOCUMENTS

| | | | | |
|---|---|---|---|---|
| 6,314,646 | B1 * | 11/2001 | Schmidt | B26B 5/001 30/125 |
| 6,367,362 | B1 | 4/2002 | Brazell et al. | |
| 6,378,217 | B1 | 4/2002 | Takamura et al. | |
| 6,516,523 | B1 | 2/2003 | Lin | |
| 6,554,030 | B2 | 4/2003 | Cheung et al. | |
| 6,581,293 | B1 | 6/2003 | Andersen | |
| 6,647,630 | B1 | 11/2003 | Lucas et al. | |
| 6,684,679 | B2 | 2/2004 | Hsieh | |
| 6,751,874 | B2 | 6/2004 | Eldar | |
| 6,772,521 | B2 | 8/2004 | Nordlin et al. | |
| 6,915,579 | B2 | 7/2005 | Cofer | |
| 6,973,729 | B2 | 12/2005 | Nordlin | |
| 6,981,327 | B2 | 1/2006 | Nordlin | |
| 6,990,781 | B2 | 1/2006 | Sundstrom | |
| 7,069,758 | B2 | 7/2006 | Kariakin et al. | |
| 7,146,738 | B2 | 12/2006 | Yu | |
| 7,165,319 | B2 | 1/2007 | Itrich | |
| 7,290,342 | B2 * | 11/2007 | Hartmann | B27B 9/02 30/376 |
| 7,334,340 | B2 | 2/2008 | Eldar | |
| 7,584,878 | B2 | 9/2009 | Kandasamy | |
| 7,797,840 | B2 | 9/2010 | Bublitz et al. | |
| 8,122,805 | B2 | 2/2012 | Liu | |
| 2004/0123713 | A1 * | 7/2004 | Cofer | B26F 1/36 83/522.19 |
| 2010/0000288 | A1 * | 1/2010 | Barezzani | B25B 27/146 72/453.15 |
| 2010/0107426 | A1 | 5/2010 | Cedar | |
| 2011/0146085 | A1 | 6/2011 | Moffatt et al. | |
| 2011/0185874 | A1 | 8/2011 | Blair | |

* cited by examiner

PUNCH

CROSS-REFERENCE TO RELATED APPLICATIONS

This application is a non-provisional of and claims priority to U.S. Provisional Application No. 62/024,709, entitled "Punch," filed Jul. 15, 2014, which is incorporated herein by reference in its entirety.

BACKGROUND

During the course of installing electrical wiring, an electrician may have a need to cut holes in metal studs and boxes. To do this the electrician may utilize a saw, tin snips, or a punch.

SUMMARY

The present disclosure is directed to a device for punching holes in a material. According to various embodiments of the concepts and technologies described herein, the device can include a body, a fixed handle attached to the body, and a moveable handle attached to the body. The device can further include a cutting die and an adjustable depth gauge attached to the body. The adjustable depth gauge can be moveable relative to the body of the device.

This Summary is provided to introduce a selection of concepts in a simplified form that are further described below in the Detailed Description. This Summary is not intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

The accompanying drawings, which are incorporated in and constitute a part of this disclosure, illustrate various embodiments of the present invention. In the drawings.

DETAILED DESCRIPTION

Figure 1:
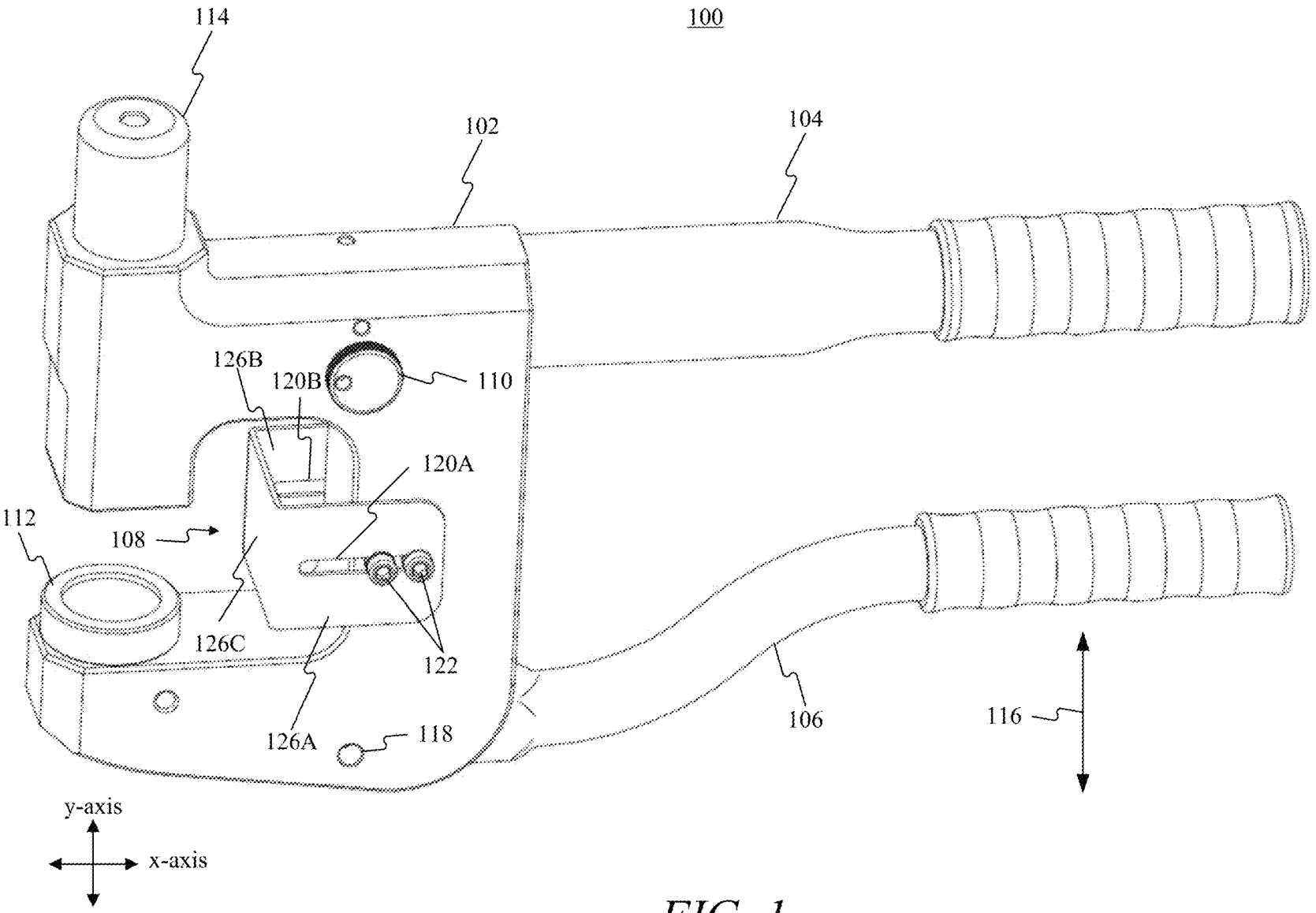
FIG. 1 shows a punch and an adjustable depth gauge, according to an exemplary embodiment.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

The following detailed description is directed to devices, methods, and apparatuses for punching a hole in a material.

Consistent with embodiments of the disclosure, a punch is provided. The punch comprises a body, a fixed handle, a moveable handle, and an adjustable depth gauge. The fixed handle is fixedly attached to the body. The moveable handle and the adjustable depth gauge are moveably attached to the body.

Turning now to the figures, FIG. 1 shows a punch 100. The punch 100 comprises a body 102, a fixed handle 104, a moveable handle 106, and an adjustable depth gauge 108. Other features of the punch 100 include a fluid return nut 110, a die cup 112, and a cylinder 114. During operation, the moveable handle 106 moves as indicated by arrow 116 and pivots about a pivot point 118. In addition, and as discussed in greater detail below, the adjustable depth gauge 108 may be repositioned as needed.

Figure 2:
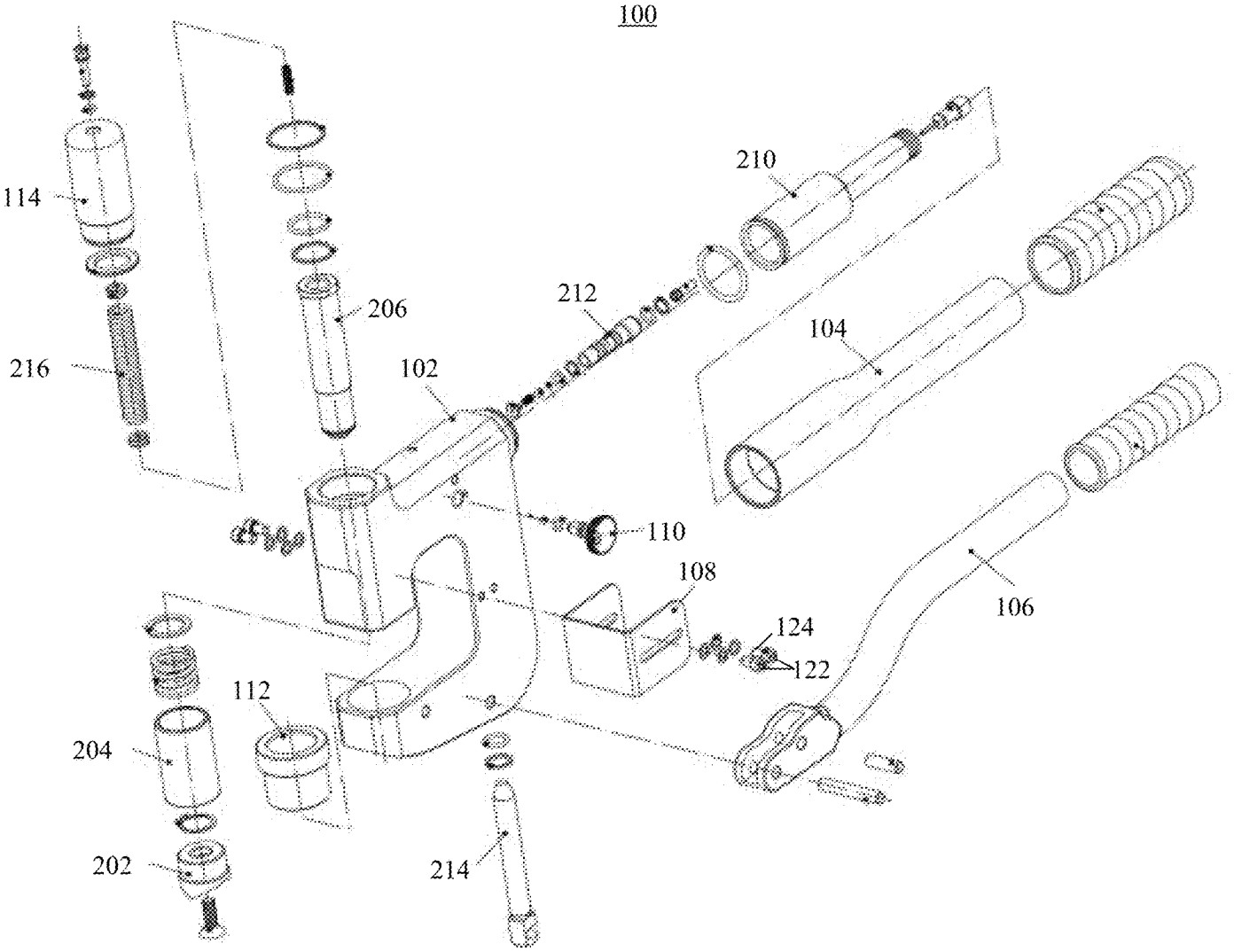
FIG. 2 shows an exploded assembly of the punch and the adjustable depth gauge, according to an exemplary embodiment.

Turning now to FIG. 2 an exploded assembly of the punch 100 is shown. According to embodiments, the punch 100 further includes a cutting die 202 housed in a guide sleeve 204 and connected to a piston rod 206. The piston rod 206 is housed within the cylinder 114. During operation as the moveable handle 106 is moved, fluid (not shown) travels from a fluid reservoir 210 housed within the fixed handle 104 and enters the body 102 via a valve body 212 (described in detail below with regards to FIG. 3). The fluid is withdrawn from the fluid reservoir 210 by a pressure drop caused by a piston 214 traveling into and out of a cavity (see FIG. 3) located within the body 102. Once in the body 102, the fluid travels into the cylinder 114 and applies pressure to the piston rod 206. The applied pressure causes the piston rod 206 and the sleeve 204 housing the cutting die 202 connected to the piston rod 206 to travel towards the die cup 112 and causes a spring 216 to enter an extended state. Depending on the size of the punch 100, the number of actuations of the moveable handle 106 to cause the cutting die 202 to reach the die cup 112 may vary. For example, for a large punch, the number of actuations may be between 10 and 15, and for a small punch, the number of actuations may be between 5 and 10.

During operation, a material, such a piece of sheet metal for example, is located between the cutting die 202 and the die cup 112. As the cutting die 202 passes into the die cup 112, a hole is punched in the material. For example, during use, an electrician may place a metal stud between the cutting die 202 and the die cup 112. The electrician may then actuate the moveable handle 106 to cause the cutting die 202 to punch a hole in the metal stud.

Once the cutting die 202 has entered the die cup 112, the fluid return nut 110 may be used to open an alternate fluid path or open a valve to allow the fluid to return from the cylinder 114 to the fluid reservoir 210. Upon opening the alternate fluid path or the valve to allow the fluid to return from the cylinder 114 to the fluid reservoir 210, the spring 216 may return to a contracted state from the extended state. For example, as the spring 216 returns to the contracted state, the spring 216 causes the piston rod 206 to recede into the body 102 and thereby forces the fluid though the alternate path, or the valve body 212, back into the fluid reservoir 210. To use the punch 100 again, the fluid return nut 110 may be used to block the alternate path, or close the valve, such that the fluid is restricted to a fluid path leading to the cylinder 114.

Figure 3:
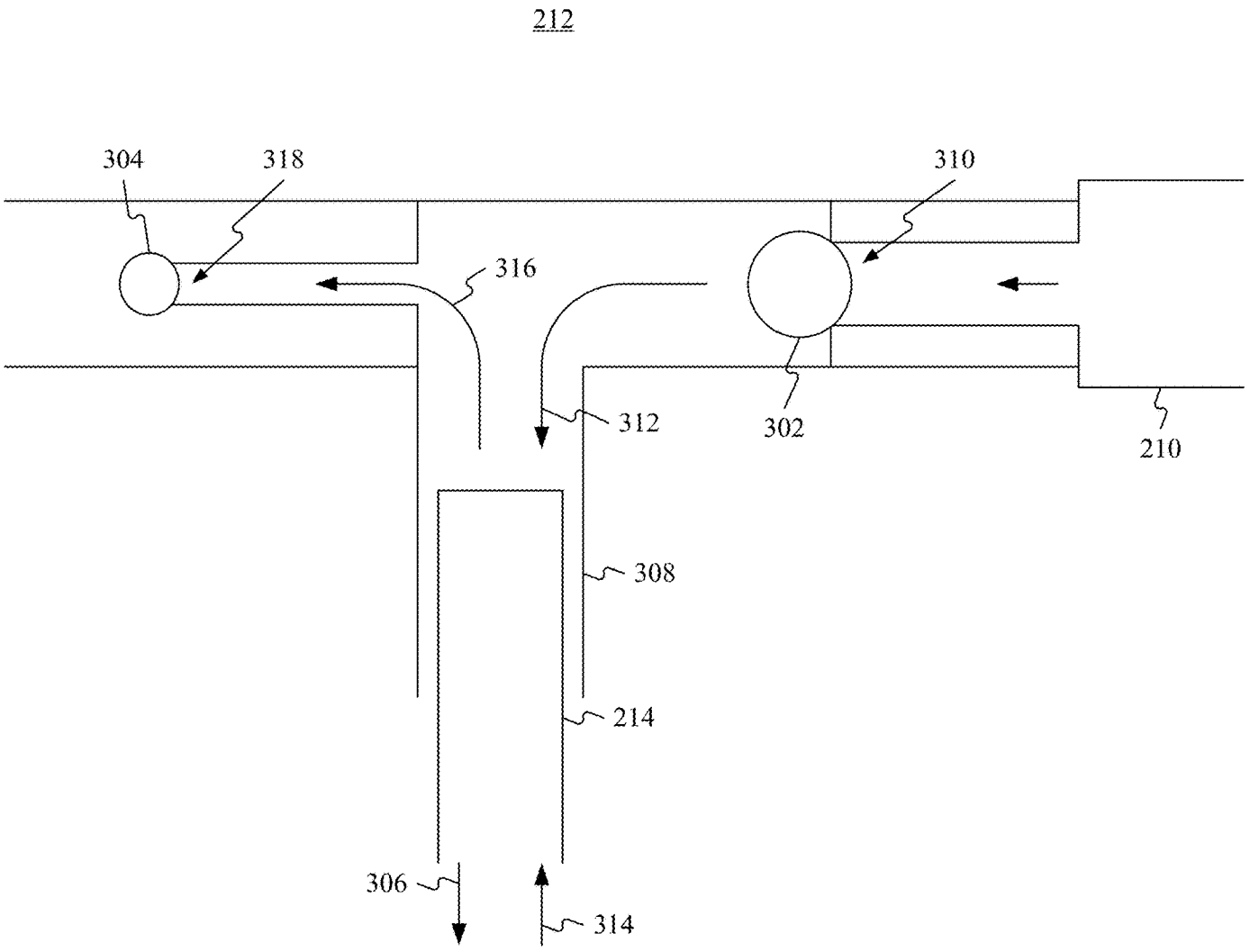
FIG. 3 shows a schematic of a valve body according to an exemplary embodiment.

Turning now to FIG. 3, the valve body 212 is shown in greater detail. The valve body 212 includes a first ball bearing 302 and a second ball bearing 304. During actuation of the moveable handle 106 as indicated by arrow 116 illustrated in FIG. 1, the piston 214 travels in a first direction as indicated by arrow 306. As the piston 214 travels in the first direction indicated by arrow 306, the volume within a cavity 308 increases causing a pressure drop. The pressure drop causes the fluid to travel from the fluid reservoir 210 into the cavity 308. As the fluid flows from the fluid reservoir 210, the fluid traveling into the cavity 308 causes the first ball bearing 302 to move such that a first opening 310 is not blocked by the first ball bearing 302. The movement of the first ball bearing 302 allows the fluid to flow as indicated by arrow 312.

As the moveable handle 106 is further actuated, the piston 214 travels in a second direction as indicated by arrow 314. As the piston 214 travels in the second direction indicated by arrow 314, the volume within the cavity 308 decreases causing a pressure increase within the body 102. The pressure increase causes the first ball bearing 302 (possibly assisted by a spring, not shown in FIG. 3) to block the first opening 310. By blocking the first opening 310, the fluid is hindered from returning to the fluid reservoir 210. As the pressure within the cavity 308 increases, the fluid is forced in a direction as indicated by arrow 316. The fluid flow, as indicated by arrow 316, causes the fluid to flow past the second ball bearing 304.

As the fluid flows past the second ball bearing 304, the fluid flows through the body 102 and into the cylinder 114 to cause the cutting die 202 to extend through the die cup 112. During movement of the piston 214 as indicated by arrow 306, the second ball bearing 304 blocks a second opening 318. The movement of the second ball bearing 304 to a position blocking the second opening 318 may be assisted by a spring (not shown in FIG. 3). As indicated above, when there is a desire to retract the cutting die 202, the fluid return nut 110 is used to open an alternate path or open a valve for the fluid to flow back to the fluid reservoir 210.

The fluid used for the punch 100 can include any incompressible fluid. Non-limiting examples include mineral oil and water. In addition, the moveable handle 106/piston 214 assembly used to cause fluid flow may be replaced with an electric pump. For example, an electric pump may be used to cause the fluid to flow and may be controlled by controls located on the fixed handle 104.

Turning now to FIGS. 1, 2, 4A, and 4B, embodiments of the adjustable depth gauge 108 are described in more detail. According to embodiments, the adjustable depth gauge 108 can be moved to various positions relative to the body 102 of the punch 100 to vary a distance between the adjustable depth gauge 108 and the cutting die 202 of the punch 100, allowing the adjustable depth gauge 108 to work as a guide for positioning and aligning a material, such as a frame or stud, to be punched by the cutting die 202. Each of the various positions of the adjustable depth gauge 108 causes a front side 126C of the adjustable depth gauge 108 to be positioned at a different distance away from a center line 414 of the cutting die 202, illustrated in FIGS. 4A-4B, to allow for materials having a variety of sizes to be positioned and aligned for punching by the punch 100 in the center of the material or at particular distances from the center of the material, as discussed further below.

According to embodiments and as illustrated in FIGS. 1 and 2, the adjustable depth gauge 108 includes a slot 120A extending through a first side 126A of the adjustable depth gauge 108 and a corresponding slot 120B extending through a second side 126B of the adjustable depth gauge 108. According to embodiments, the adjustable depth gauge 108 is secured to the punch 100 by one or more fasteners 122, each having a body 124, shown in FIG. 2, that extends through the slot 120A on the first side 126A of the adjustable depth gauge 108 and into a hole extending through a first side of the body 102 of the punch 100. The adjustable depth gauge 108 may be further secured to the punch 100 by one or more fasteners (not shown), each having a body portion that extends through the corresponding slot 120B on the second side 126B of the adjustable depth gauge 108 and into a hole extending through a second side of the body 102 of the punch 100. Non-limiting examples of the fasteners 122 include screws, spring-loaded pull pins, and indexing plungers When the fasteners 122 are loosened, the adjustable depth gauge 108 can be slid about the fasteners 122 along a length of the slot 120A to adjust a position of the adjustable depth gauge 108 along a x-axis relative to the body 102 of the punch 100 such that a distance between the front side 126C of the adjustable depth gauge 108 and the center line 414 of the cutting die 202 is varied. According to embodiments, the adjustable depth gauge 108 can be adjusted from an extended position illustrated in FIG. 1 to a contracted position illustrated by the adjustable depth gauge 108 of FIG. 4B, where the adjustable depth gauge 108 is slid, via the slot 120A along the x-axis, about the fasteners 122 towards the body 102 of the punch until the front side 126C of the adjustable depth gauge 108 is substantially flush with the body 102 of the punch 100. As the adjustable depth gauge 108 is adjusted from the extended position to the contracted position, the fasteners 122 can be tightened to fix the adjustable depth gauge 108, and specifically the front side 126C of the adjustable depth gauge 108, at any number of distances from the center line 414 of the cutting die 202. As mentioned above, this ability to adjust the adjustable depth gauge 108 along the x-axis relative to the body 102 of the punch 100 to achieve various distances from the center line 414 of the cutting die 202 allows the adjustable depth gauge 108 to work as a guide for positioning a material to be punched by the cutting die 202 of the punch 100. Each of the various positions of the adjustable depth gauge 108 causes the front side 126C of the adjustable depth gauge 108 to be positioned at a different distance away from the center line 414 of the cutting die 202 to allow for materials having a variety of sizes to be positioned and aligned for punching by the punch 100 in the center of the material or at particular distances from the center of the material, as discussed further below.

Figure 4A:
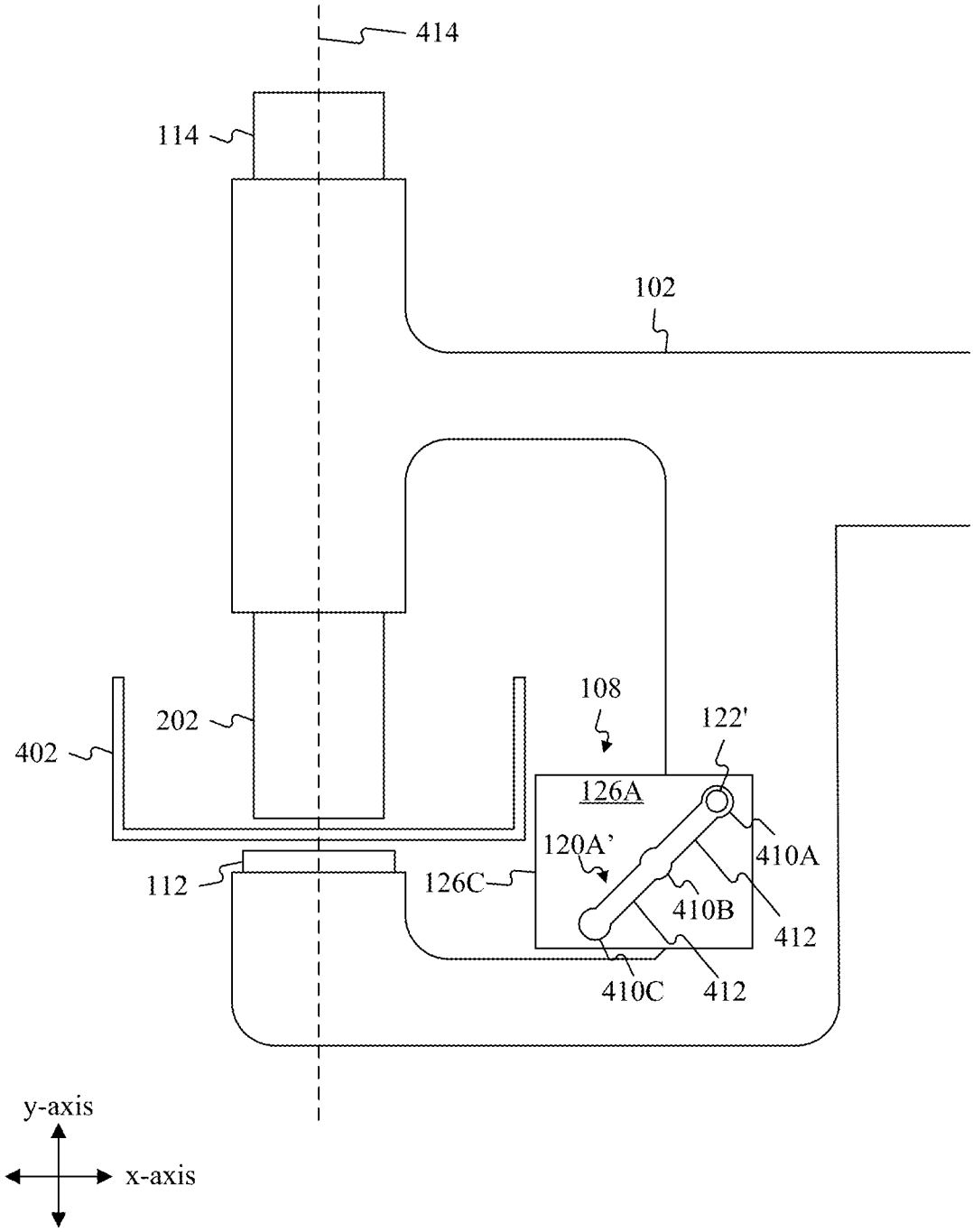
FIGS. 4A and 4B show a body of the punch and the adjustable depth gauge, according to an alternative exemplary embodiment.
Figure 4B:
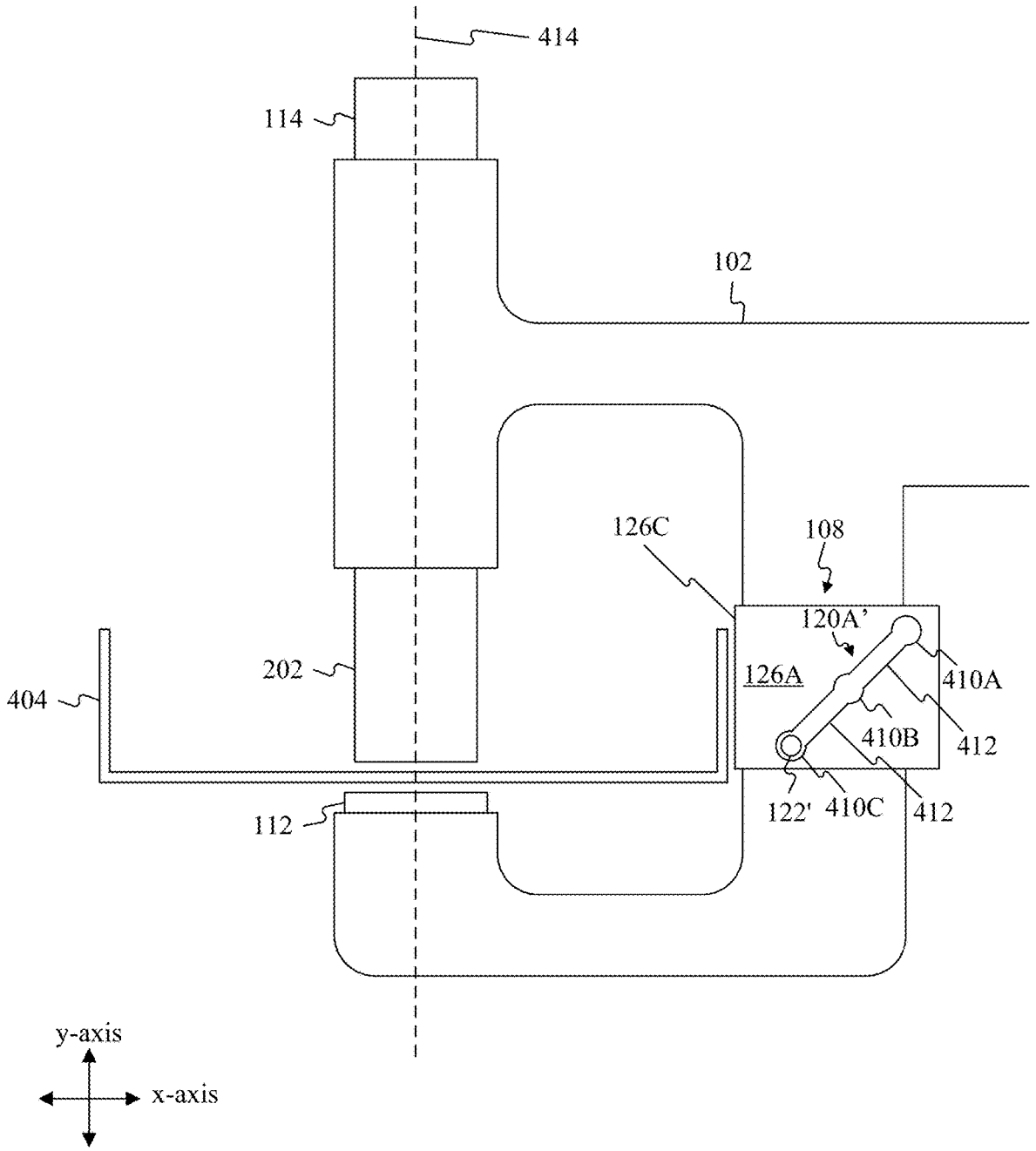

FIGS. 4A-4B show an alternative embodiment of the adjustable depth gauge 108. The adjustable depth gauge 108 illustrated in FIGS. 4A-4B includes a slot 120A' extending through the first side 126A of the adjustable depth gauge 108. The adjustable depth gauge 108 may also include a corresponding slot (not shown) extending through the second side 126B of the adjustable depth gauge 108. As further illustrated in FIGS. 4A-4B, the slot 120A' may include straight portions 412 and flared openings 410A, 410B, and 410C, each having a diameter that is greater than a width of the straight portions 412 of the slot 120A'. According to embodiments, the adjustable depth gauge 108 is secured to the punch 100 by one or more fasteners 122', each having a body portion that extends through the slot 120A' on the first side 126A of the adjustable depth gauge 108 and into a hole extending through the first side of the body 102 of the punch 100. The adjustable depth gauge 108 may be further secured to the punch 100 by one or more fasteners (not shown), each having a body portion that extends through the corresponding slot on the second side 126B of the adjustable depth gauge 108 and into a hole extending through the second side of the body 102 of the punch 100. Non-limiting examples of the fasteners 122' include spring-loaded pins and set screws.

According to embodiments, the body of the fastener 122' includes a top portion and a bottom portion. Unlike the body 124 of the fastener 122 of FIGS. 1 and 2, which has a substantially similar diameter throughout, a diameter of the bottom portion of the body of the fastener 122' is larger than a diameter of the top portion of the body of the fastener 122'. According to some embodiments, the top portion of the body of the fastener 122' has a diameter sized to fit within both the straight portions 412 and the flared openings 410A-410C of the slot 120A', where the diameter of the bottom portion of the body of the fastener 122' is sized to fit within the flared openings 410A-410C but is greater than the width of the straight portions 412 of the slot 120A'. According to some embodiments, the bottom portion of the fastener 122' is connected to a spring (not shown).

Since the diameter of the bottom portion of the body of the fastener 122' is sized to fit within each of the flared openings 410A, 410B, and 410C, when the fastener 122' is positioned over one of the flared openings, such as the flared opening 410A, the fastener 122' moves into a locked position where the bottom portion of the body of the fastener 122' is allowed to extend through the flared opening 410A, locking the adjustable depth gauge 108 in a position, such as the extended position illustrated in FIG. 4A, relative to the body 102 of the punch 100 at a first distance between the front side 126C of the adjustable depth gauge 108 and the center line 414 of the cutting die 202, since the diameter of the bottom portion of the body of the fastener 122' is larger than the width of the straight portions 412 of the slot 120A'. In order to move the adjustable depth gauge 108 from the extended position illustrated in FIG. 4A to the contracted position illustrated in FIG. 4B, the fastener 122' can be shifted to an unlocked position by pushing the fastener 122' in towards the adjustable depth gauge 108, causing the bottom portion of the body of the fastener 122' to withdraw from the flared opening 410A and move below the flared opening 410A and further causing the top portion of the body of the fastener 122' to extend through the flared opening 410A. According to embodiments, since the diameter of the top portion of the body of the fastener 122' is smaller than the diameter of the flared opening 410A, when the fastener 122' is moved to the unlocked position while still positioned over the flared opening 410A, the adjustable depth gauge 108 shifts downward relative to the body 102 of the punch 100 causing an edge of the flared opening 410A to block the bottom portion of the body of the fastener 122' from extending back through the flared opening 410A. Since the diameter of the top portion of the body of the fastener 122' is sized to fit within the straight portions 412 and the flared openings 410A-410C of the slot 120A', when the fastener 122' is in the unlocked position, the adjustable depth gauge 108 can be moved about the fastener 122' along both the x-axis and a y-axis, based on the diagonal configuration of the slot 120A', relative the body 102 of the punch 100 to change the distance between the front side 126C of the adjustable depth gauge 108 and the center line 414 of the cutting die 202. When the adjustable depth gauge 108 is moved relative to the body 102 of the punch 100 along both the x-axis and the y-axis to position the fastener 122' over the flared opening 410C, the fastener 122' moves back into the locked position where the bottom portion of the body of the fastener 122' is allowed to extend through the flared opening 410C, locking the adjustable depth gauge 108 in the contracted position illustrated in FIG. 4B relative to the body 102 of the punch 100 at a second distance between the front side 126C of the adjustable depth gauge 108 of the center line 414 of the cutter die 202.

The adjustable depth gauge 108 may be adjusted to a first position associated with the flared opening 410A, such as the extended position illustrated in FIG. 4A. The first position may correspond for use with a certain sized material. For example, the first position may correspond for use with a 4 inch metal stud 402 since placing the adjustable depth gauge 108 in the first position causes the front side 126C of the adjustable depth gauge 108 to be at or approximately 2 inches from the center line 414 of the cutting die 202. By having the adjustable depth gauge 108 in the first position, the cutting die 202 may be centered within the 4 inch metal stud 402. Use of the adjustable depth gauge 108 may allow a user to more quickly punch holes within the center of materials by allowing the user to set the punch 100 for a given size of a material, thus eliminating the need for the user to have to measure the location for each hole to be punched in the material.

The adjustable depth gauge 108 may be adjusted to a second position associated with the flared opening 410C, such as the contracted position illustrated in FIG. 4B. The second position may correspond for use with a certain sized material. For example, the second position may correspond for use with a 6 inch metal stud 404 since placing the adjustable depth gauge 108 in the second position causes the front side 126C of the adjustable depth gauge 108 to be at or approximately 3 inches from the center line 414 of the cutting die 202. By having the adjustable depth gauge 108 in the second position, the cutting die 202 may be centered within the 6 inch metal stud 404. Use of the adjustable depth gauge 108 may allow a user to more quickly punch holes within the center of materials by allowing the user to set the punch 100 for a given size of a material, thus eliminating the need for the user to have to measure the location for each hole to be punched in the material.

While FIGS. 4A and 4B show the adjustable depth gauge 108 being set to a first position and a second position with the option also to set the adjustable depth gauge 108 to a third position associated with the flared opening 410B, the adjustable depth gauge 108 may be set at any number of positions between the first position and the second position relative to the body 102 of the punch 100, achieving a variety of distances between the front side 126C of the adjustable depth gauge 108 and the center line 414 of the cutter die 202, as discussed above with reference to FIGS. 1 and 2. In addition to using the adjustable depth gauge 108 as a guide for aligning a material relative to the cutting die 202 such that the cutting die 202 punches a hole within the center of the material, the adjustable depth gauge 108 can also be used to punch holes within materials at a certain measurement off of the center of the materials. According to embodiments, for example, the adjustable depth gauge 108 includes markings to allow for one or more measurements from the center of the cutting die 202. For instance, the adjustable depth gauge 108 may include markings that denote increments of ¼ of an inch away from the center of the cutting die 202. The adjustable depth gauge 108 may be constructed of various materials such as, for example, metals and/or plastics.

While certain embodiments of the invention have been described, other embodiments may exist. While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as examples for embodiments of the invention.

What is claimed is:

1. A device comprising:

a body comprising a first leg, a second leg, a connecting leg, a cavity, a piston moveable within the cavity, and a cylinder, wherein the cylinder houses a piston rod;

a cutting die attached to the piston rod;

a die cup located in between the first leg and the second leg of the body;

a fixed handle attached to the body at a junction of the first leg and the connecting leg of the body;

a fluid reservoir housed within the fixed handle;

a moveable handle attached to the body at a junction of the second leg and the connecting leg of the body, wherein actuation of the moveable handle causes the piston to move in a first direction within the cavity causing a volume within the cavity to increase and a pressure within the cavity to decrease such that a fluid retained in the fluid reservoir housed within the fixed handle flows from the fluid reservoir past a first ball bearing and into the cavity, wherein further actuation of the moveable handle causes the piston to move in a second direction within the cavity opposite of the first direction causing the volume within the cavity to decrease and the pressure within the cavity to increase such that the fluid in the cavity flows from the cavity past a second ball bearing into the cylinder housing the piston rod causing the piston rod and the cutting die attached to the piston rod to move in a direction along that of a first axis, wherein the direction of movement of the piston rod is parallel to the first direction and the second direction of movement of the piston, and wherein the direction of movement of the piston rod is perpendicular to an axis of the fixed handle; and an adjustable depth gauge attached to the body, the adjustable depth gauge comprising a first side comprising a slot for receiving a fastener to movably attach the adjustable depth gauge to the body, wherein the slot comprises a diagonal configuration, a second side, and a front side comprising a material-abutting surface that connects the first side and the second side of the adjustable depth gauge, wherein the adjustable depth gauge, when attached to the body, is moveable about the fastener from a first position to a second position to a third position, wherein as the adjustable depth gauge moves about the fastener from the first position to the second position to the third position, the adjustable depth gauge moves, based on the diagonal configuration of the slot, along both the first axis to position the front side of the adjustable depth gauge at a plurality of different heights along the first axis relative to the cutting die attached to the piston rod and a second axis to position the front side of the adjustable depth gauge at a plurality of different distances along the second axis from the cutting die attached to the piston rod, wherein the slot further comprises a plurality of straight portions and a plurality of flared openings, wherein a first flared opening of the plurality of flared openings is at a first location on the slot to adjust the adjustable depth gauge to the first position, wherein the first position corresponds to a first sized material such that the cutting die is positioned within a center of the first sized material when the first sized material is located between the cutting die and the die cup and proximate the front side of the adjustable depth gauge at the first position, wherein a second flared opening of the plurality of flared openings is at a second location on the slot to adjust the adjustable depth gauge to the second position, wherein the second position corresponds to a second sized material such that the cutting die is positioned within a center of the second sized material when the second sized material is located between the cutting die and the die cup and proximate the front side of the adjustable depth gauge at the second position, wherein a third flared opening of the plurality of flared openings is at a third location on the slot to adjust the adjustable depth gauge to the third position, wherein the third position corresponds to a third sized material such that the cutting die is positioned within a center of the third sized material when the third sized material is located between the cutting die and the die cup and proximate the front side of the adjustable depth gauge at the third position, wherein each of the plurality of flared openings has a diameter that is greater than a width of each of the plurality of straight portions, wherein the fastener comprises a top portion and a bottom portion, wherein the bottom portion of the fastener has a diameter that is larger than a diameter of the top portion of the fastener, wherein the diameter of the top portion of the fastener fits within the diameter of each of the plurality of straight portions of the slot and within the diameter of each of the plurality of flared openings of the slot, and wherein the diameter of the bottom portion of the fastener fits within the diameter of each of the plurality of flared openings of the slot but is greater than the diameter of each of the plurality of straight portions of the slot.

2. The device of claim 1, wherein the adjustable depth gauge is fixed at a first distance from the cutting die and at a first height relative to the cutting die when the adjustable depth gauge is moved to position the fastener over the first flared opening of the slot, wherein the adjustable depth gauge is fixed at a second distance from the cutting die and a second height relative to the cutting die when the adjustable depth gauge is moved to position the fastener over the second flared opening of the slot, and wherein the adjustable depth gauge is fixed at a third distance from the cutting die and a third height relative to the cutting die when the adjustable depth gauge is moved to position the fastener over the third flared opening of the slot.

3. The device of claim 2, further comprising a valve, wherein the fluid retained in the fluid reservoir flows into the cavity and into the cylinder via the valve, the valve comprising the first ball bearing and the second ball bearing.

4. The device of claim 1, wherein when the fluid flows into the cylinder, the fluid applies pressure to the piston rod causing the piston rod and the cutting die attached to the piston rod to move along the first axis towards the die cup to punch a hole in a material located between the cutting die and the die cup.

5. The device of claim 1, wherein the fastener is in a locked position such that the adjustable depth gauge is locked in a position relative to the body when the bottom portion of the fastener extends through one of the plurality of flared openings causing the top portion of the fastener to extend above the one of the plurality of flared openings, and wherein the fastener is in an unlocked position such that the adjustable depth gauge is unlocked from the position relative to the body when the fastener is pushed towards the adjustable depth gauge causing the bottom portion of the fastener to extend below the one of the plurality of flared openings and the top portion of the fastener to extend through the one of the plurality of flared openings.

* * * * *